US007802868B2

(12) United States Patent
Ohta

(10) Patent No.: US 7,802,868 B2
(45) Date of Patent: Sep. 28, 2010

(54) NOZZLE PLATE, METHOD OF MANUFACTURING NOZZLE PLATE, LIQUID EJECTION HEAD AND IMAGE FORMING APPARATUS

(75) Inventor: Hiroshi Ohta, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 338 days.

(21) Appl. No.: 12/027,896

(22) Filed: Feb. 7, 2008

(65) Prior Publication Data

US 2008/0189947 A1 Aug. 14, 2008

(30) Foreign Application Priority Data

Feb. 9, 2007 (JP) ..... 2007-031123

(51) Int. Cl.
*B41J 2/045* (2006.01)

(52) U.S. Cl. ..... 347/40; 347/68

(58) Field of Classification Search ..... 347/40, 347/43, 65–66, 68, 71; 29/890.1; 216/27
See application file for complete search history.

(56) References Cited

U.S. PATENT DOCUMENTS 6,508,539 B2 * 1/2003 Tanaka ..... 347/54
7,117,597 B2 * 10/2006 Nishida ..... 29/890.1
7,255,977 B2 * 8/2007 Yokouchi ..... 430/320

FOREIGN PATENT DOCUMENTS

JP 2001-38913 A 2/2001
JP 2001-187453 A 7/2001

* cited by examiner

*Primary Examiner*—Lamson D Nguyen
(74) *Attorney, Agent, or Firm*—Birch, Stewart, Kolasch & Birch, LLP

(57) ABSTRACT

The nozzle plate has: a first metal layer in which a hole section corresponding to a nozzle hole is formed; a liquid-repellent layer formed on a front surface of the first metal layer, an inner surface of the hole section in the first metal layer, and an opening perimeter region of the hole section on a rear surface of the first metal layer; and a second metal layer formed on a rear surface side of the first metal layer, wherein the liquid-repellent layer on the rear surface of the first metal layer is sandwiched between the first metal layer and the second metal layer.

3 Claims, 10 Drawing Sheets

TEST CONDITIONS a) ROOM TEMPERATURE 25±5 (° C), HUMIDITY 50±10 (%)

b) VOLUME OF DROPLET : NO LESS THAN 1 (μl) AND NO MORE THAN 4 (μl)

c) MEASUREMENT TIME : WITHIN ONE MINUTE AFTER LEAVING DROPLET IN STATIONARY STATE ON TEST PIECE d) WATER USED IS DISTILLED WATER

NOZZLE PLATE, METHOD OF MANUFACTURING NOZZLE PLATE, LIQUID EJECTION HEAD AND IMAGE FORMING APPARATUS

BACKGROUND OF THE INVENTION

1. Field of the Invention

The present invention relates to a nozzle plate, a method of manufacturing a nozzle plate, a liquid ejection head and an image forming apparatus, and more particularly, to a nozzle plate provided in an inkjet type of liquid ejection head which ejects a liquid droplet (ink droplet) from a nozzle (a nozzle hole).

2. Description of the Related Art

In general, the recording head of an inkjet recording apparatus (inkjet head) comprises a nozzle forming substrate (nozzle plate) in which a plurality of nozzle holes are formed, and it performs recording on a recording medium by pressurizing the ink inside pressure chambers, through the use of energy generating devices such as piezoelectric elements or heat-generating elements, for example, thereby causing ink droplets to be ejected respectively from the nozzles connected to the pressure chambers.

To form such a nozzle plate, for example, a resist pattern corresponding to the nozzle holes is formed on a conductive substrate, and an overhang electroforming process is then carried out to precipitate a metal material such as nickel onto the conductive substrate so as to cover a portion of the resist pattern, whereby trumpet-shaped (curved) nozzle holes which converge in diameter toward the ink ejection side are formed in the substrate. By adopting a nozzle hole shape of this kind, it is possible to restrict loss of the ejection energy applied by the energy generating device, and therefore it is possible to improve the ejection efficiency of the inkjet head.

Furthermore, it is known that in an inkjet head, the shape, accuracy, and the like, of the nozzle holes affect the ink droplet ejection characteristics, and furthermore, that the surface characteristics of the nozzle plate also affect the ink droplet ejection characteristics. For example, if ink adheres to the nozzle perimeter regions on the surface of the nozzle plate, then problems may arise in that the ejection direction of the ink droplets is deflected, variation occurs in the size of the ink droplets, the ejection speed of the ink droplets becomes instable, and so on. In order to prevent these problems, in general, a lyophobic film (liquid-repellent film) is formed on the surface (ink ejection surface) of the nozzle plate, with the purpose of stabilizing the ink droplet ejection characteristics.

Japanese Patent Application Publication No. 2001-38913 teaches a method in which, in order to form a lyophobic film on the surface of the nozzle plate, a lyophobic film is formed after masking the interiors of the nozzle holes with resist. However, according to this method, the meniscus comes to vibrate on the side adjacent to the surface of the nozzle plate, the ink wets and spreads onto the surface of the nozzle plate, and therefore the ink droplet ejection characteristics become instable.

On the other hand, Japanese Patent Application Publication No. 2001-187453 discloses a nozzle plate in which, in order to achieve stable ejection of ink droplets, a portion of a lyophobic layer (ink-repelling film layer) which covers the surface of the nozzle plate is made to enter into and extend over the inner surfaces of the nozzle holes.

However, in the nozzle plate described in Japanese Patent Application Publication No. 2001-187453, the amount by which the lyophobic layer extends over the inner surfaces of the nozzle holes is governed by a photosensitive resin film which is introduced inside the nozzles by heating and pressurization, and taking account of the temperature distribution, pressure distribution, and the like, it is difficult to achieve a uniform amount of extension of the lyophobic layer into the nozzles, over the whole of the plate.

Furthermore, in the nozzle plate described in Japanese Patent Application Publication No. 2001-187453, the lyophobic layer is formed by eutectoid plating of a fluorine polymer material, but there is a possibility that step differences are created in the eutectic plating layer on the inner surfaces of the nozzle holes and hence smooth ink flow is inhibited.

SUMMARY OF THE INVENTION

The present invention has been contrived in view of these circumstances, an object thereof being to provide a nozzle plate, a method of manufacturing a nozzle plate, a liquid ejection head and an image forming apparatus, whereby the amount by which a lyophobic layer (liquid-repellent layer) extends over the inner surfaces of the nozzle holes can be controlled accurately.

An aspect of the invention is directed to a nozzle plate comprising: a first metal layer in which a hole section corresponding to a nozzle hole is formed; a liquid-repellent layer formed on a front surface of the first metal layer, an inner surface of the hole section in the first metal layer, and an opening perimeter region of the hole section on a rear surface of the first metal layer; and a second metal layer formed on a rear surface side of the first metal layer, wherein the liquid-repellent layer on the rear surface of the first metal layer is sandwiched between the first metal layer and the second metal layer.

In this aspect of the invention, a liquid-repellent (lyophobic) layer is disposed in a square U shape from the front surface of the first metal layer, over the inner surface of the hole section and along the rear surface of the first metal layer, and therefore it is possible accurately to control the amount by which the liquid-repellent layer extends over the inner surface of the nozzle hole, in accordance with the thickness of the first metal layer. Consequently, it is possible accurately to specify the position of the meniscus inside the nozzle hole, and therefore the ejection stability is improved.

Another aspect of the invention is directed to a method of manufacturing a nozzle plate, comprising the steps of: forming a first metal layer having a hole section corresponding to a nozzle hole; forming a liquid-repellent layer on a front surface of the first metal layer, an inner surface of the hole section in the first metal layer, and an opening perimeter region of the hole section on a rear surface of the first metal layer; and forming a second metal layer on a rear surface side of the first metal layer so as to cover the liquid-repellent layer on the rear surface of the first metal layer, by overhang electroforming.

In this aspect of the invention, the liquid-repellent (lyophobic) layer is formed in a square U shape from the front surface of the first metal layer, over the inner surface of the hole section, and along the rear surface, and a second metal layer is formed on the rear surface side of the first metal layer by means of an overhang electroforming process. Therefore, no step difference is created on the inner surface of the nozzle hole, and the amount by which the liquid-repellent layer extends over the inner surface of the nozzle hole can be controlled accurately in accordance with the thickness of the first metal layer. By this means, it is possible to specify accurately the meniscus position inside the nozzle hole, and to achieve a smooth flow of liquid (e.g. ink) inside the nozzle hole, and therefore ejection stability is improved.

Furthermore, since the liquid-repellent layer is formed after forming the first metal layer, whereupon the second metal layer is formed, then the processing steps are simplified in comparison with a case where the liquid-repellent layer is processed additionally after fabrication of the nozzle plate. Therefore, the productivity of a nozzle plate is improved.

There are a mode where the liquid-repellent layer on the rear surface of the first metal layer is patterned to a desired shape after forming the liquid-repellent layer, and overhang electroforming is then carried out, and a mode where the liquid-repellent layer of a desired shape has been formed from the start, on the rear surface of the first metal layer, whereupon overhang electroforming is carried out. The latter mode allows the manufacturing process to be shortened, since it does not require a patterning step to be carried out after forming the liquid-repellent layer.

Desirably, the hole section in the first metal layer has an inverted taper shape which broadens in width from the rear surface side of the first metal layer toward a front surface side of the first metal layer.

In this aspect of the invention, the internal shape of the nozzle hole is a bent shape, and hence the clip point of the meniscus in the nozzle hole is defined more clearly, and the flow resistance is also reduced.

Another aspect of the invention is directed to a liquid ejection head comprising the above-described nozzle plate.

Another aspect of the invention is directed to an image forming apparatus comprising the above-described liquid ejection head.

According to the present invention, by disposing a liquid-repellent layer in a square U shape, from the front surface of the first metal layer, over the inner surface of the hole section and along the rear surface of the first metal layer, it is possible accurately to control the amount by which the liquid-repellent layer extends over the inner surface of the nozzle hole, in accordance with the thickness of the first metal layer. Consequently, it is possible accurately to specify the position of the meniscus inside the nozzle hole, and therefore the ejection stability is improved.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
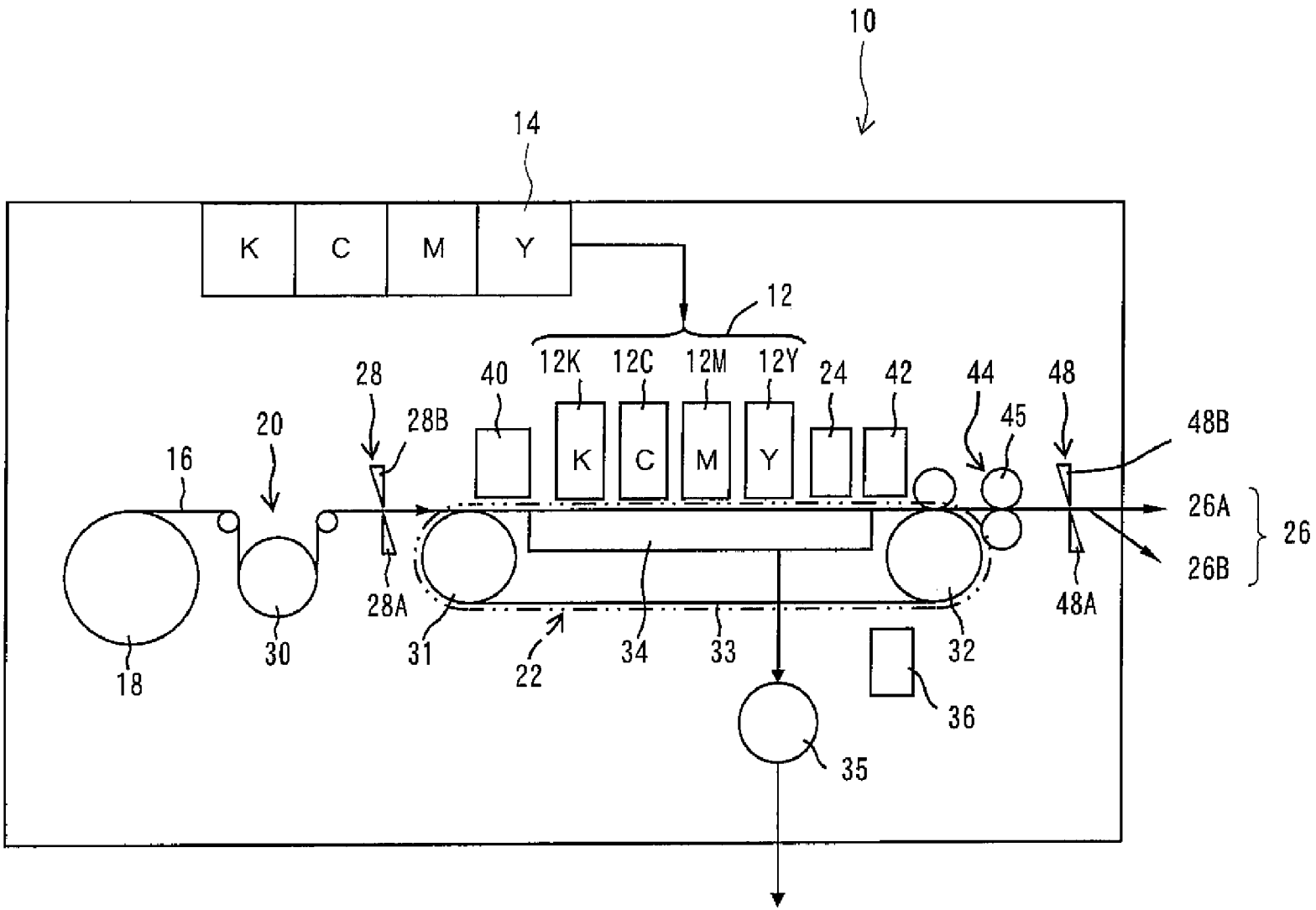
FIG. 1 is a general schematic drawing showing a general view of an inkjet recording apparatus.

Firstly, an inkjet recording apparatus which is one embodiment of the image forming apparatus relating to an embodiment of the present invention will be described. FIG. 1 is a general schematic drawing showing a general view of an inkjet recording apparatus 10. As shown in FIG. 1, the inkjet recording apparatus 10 comprises: a print unit 12 having a plurality of recording heads 12K, 12C, 12M, and 12Y for ink colors of black (K), cyan (C), magenta (M), and yellow (Y), respectively; an ink storing and loading unit 14 for storing inks of K, C, M and Y to be supplied to the recording heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway from the stationary blade 28A. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane.

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by the suction.

The belt 33 is driven in the clockwise direction in FIG. 1 by the motive force of a motor (not illustrated) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller or a water absorbent roller, an air blow configuration in which clean air is blown onto the belt 33, or the combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 comprises so-called "fill line heads" in which line heads having a length corresponding to the maximum paper width is arranged in a direction (main scanning direction) that is perpendicular to the paper conveyance direction (sub-scanning direction). Each of the recording heads 12K, 12C, 12M, and 12Y forming the print unit 12 is constituted by a line head, in which a plurality of ink ejection ports (nozzles) are arranged along a length that exceeds at least one side of the maximum-size recording paper 16 intended for use in the inkjet recording apparatus 10.

The recording heads 12K, 12C, 12M, and 12Y are arranged in the order of black (K), cyan (C), magenta (M), and yellow (Y) from the upstream side (left-hand side in FIG. 1), in the conveyance direction of the recording paper 16 (the paper conveyance direction). A color image can be formed on the recording paper 16 by ejecting the inks from the recording heads 12K, 12C, 12M, and 12Y, respectively, onto the recording paper 16 while conveying the recording paper 16.

With the print unit 12, in which the full line heads covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction perpendicular to the paper conveyance direction.

Although the configuration with the KCMY four standard colors is described in the present embodiment, combinations of the ink colors and the number of colors are not limited to those. Light inks and dark inks can be added as required. For example, a configuration is possible in which recording heads for ejecting light-colored inks such as light cyan and light magenta are added.

As shown in FIG. 1, the ink storing and loading unit 14 has tanks for storing the inks of K, C, M and Y to be supplied to the recording heads 12K, 12C, 12M, and 12Y, and the tanks are connected to the recording heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the recording heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the recording heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when the test print has been performed in the blank portion of the target print. The structure of the cutter 48 is the same as the first cutter 28 described above, and has a stationary blade 48A and a round blade 48B. Although not shown, the paper output unit 26A for the target prints is provided with a sorter for collecting prints according to print orders.

It should be noted that the recording heads 12K, 12C, 12M and 12Y of the respective ink colors have the same structure, and a reference numeral 50 is hereinafter designated to any of the recording heads.

Figure 2:
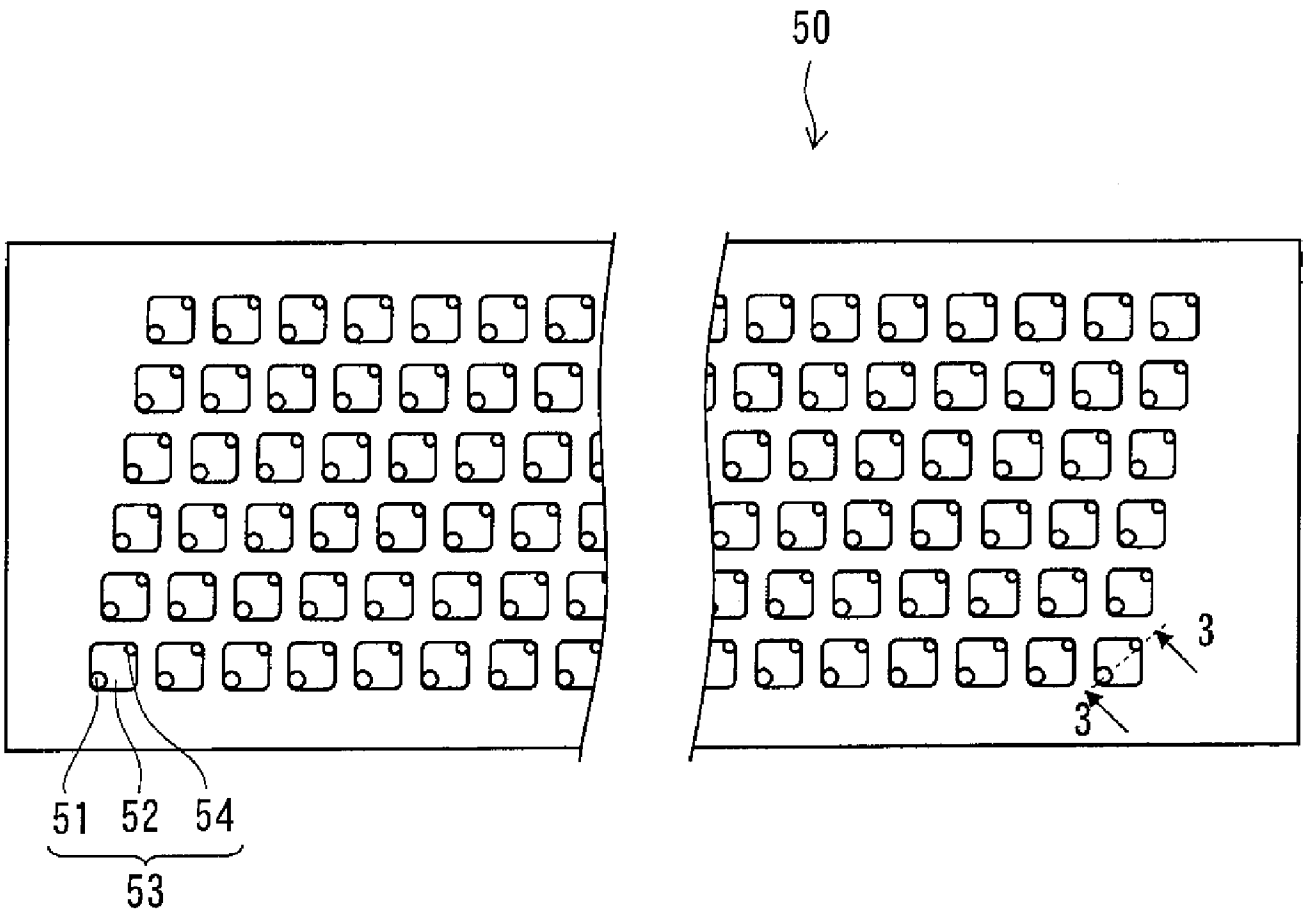
FIG. 2 is a plan view perspective diagram showing an example of the composition of a recording head.

FIG. 2 is a plan view perspective diagram showing an example of the structure of a recording head 50. As shown in FIG. 2, the recording head 50 according to the present example has a structure in which a plurality of ink chamber units (liquid droplet ejection elements forming recording element units corresponding to one nozzle) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced (high nozzle density is achieved).

The pressure chamber 52 provided corresponding to each of the nozzles 51 is approximately square-shaped in plan view, and a nozzle 51 and a supply port 54 are provided respectively at either corner of a diagonal of the pressure chamber 52. The shape of the pressure chamber 52 is not limited to that of the present example and various modes are possible in which the planar shape is a quadrilateral shape (diamond shape, rectangular shape, or the like), a pentagonal shape, a hexagonal shape, or other polygonal shapes, or a circular shape, elliptical shape, or the like. Furthermore, the arrangement of the nozzles 51 and the supply ports 54 is not limited to the arrangement shown in FIG. 2.

Figure 3:
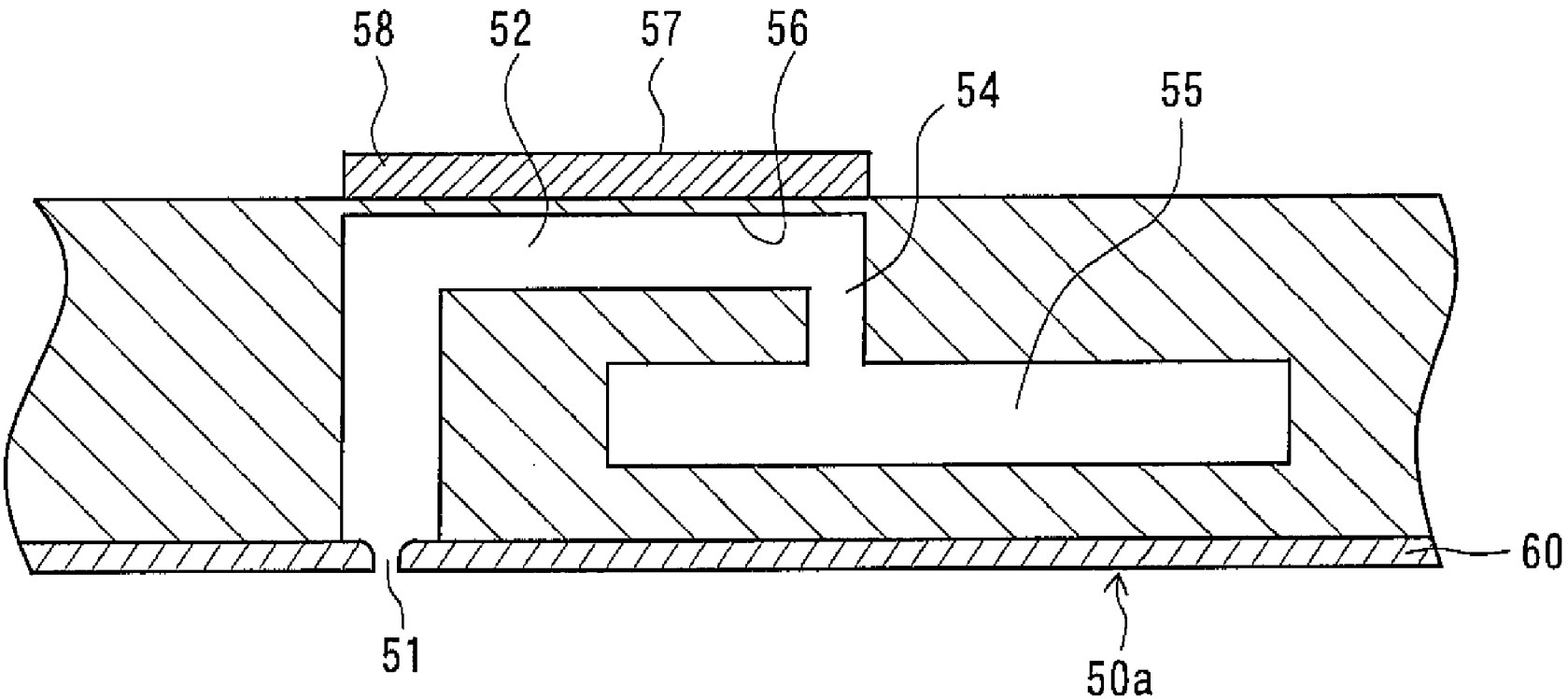
FIG. 3 is an approximate cross-sectional diagram showing one portion of the recording head along line 3-3 in FIG. 2.

FIG. 3 is an approximate cross-sectional diagram showing one portion of a recording head 50 (a cross-sectional diagram corresponding to one ink chamber unit 53). As shown in FIG. 3, a nozzle plate 60 is bonded in the front surface side (ink ejection side) of the recording head 50, and the nozzle surface 50*a* of the recording head 50 is constituted by this nozzle plate 60.

A plurality of nozzles (nozzle holes) 51 are formed in a two-dimensional configuration in the nozzle plate 60, and as shown in FIG. 3, the nozzles 51 are connected respectively to corresponding pressure chambers 52. The detailed structure of the nozzle plate 60 is described hereinafter.

A supply port 54 is formed at one end of each pressure chamber 52, and the pressure chambers 52 are connected to a common flow channel 55 by means of these respective supply ports 54. Ink supplied from the ink storing and loading unit 14 shown in FIG. 1 is distributed and supplied to the respective pressure chambers 52 via the common flow channel 55.

One wall of each pressure chamber 52 (the upper wall in FIG. 3) is constituted by a diaphragm 56, and piezoelectric elements 58 each provided with an individual electrode 57 are disposed on the diaphragm 56 at positions corresponding to the pressure chambers 52 (in other words, at positions opposing the pressure chambers 52 via the diaphragm 56). The diaphragm 56 is made of a conductive material, such as stainless steel, or the like, and it also serves as a common electrode for the plurality of piezoelectric elements 58. A mode is also possible in which the diaphragm is formed by a non-conductive material such as resin or the like, in which case a common electrode layer made of a conductive material such as metal or the like, is formed on the surface of the diaphragm member. A piezoelectric body such as a piezo element is suitable as the piezoelectric elements 58.

If a prescribed drive voltage is applied to a piezoelectric element 58 in a state where ink has been filled into the corresponding pressure chamber 52, then the ink inside the pressure chamber 52 is pressurized by the deformation of the diaphragm 56 caused by the displacement of the piezoelectric element 58, and hence an ink droplet is ejected from the corresponding nozzle 51. When the displacement of the piezoelectric element 58 returns to its original state after the ink ejection, the pressure chamber 52 is replenished with new ink from the common flow channel 55 via the supply port 54.

In the present embodiment, a piezoelectric method is adopted in which ink is ejected by utilizing the displacement of a piezoelectric element, but in implementing the present invention, there is no restriction on the ink ejection method used, and it is also possible, for example, to adopt a thermal method wherein the thermal energy generated by heating elements, such as a heater, is utilized to generate bubbles inside the pressure chambers, and ink droplets are ejected as a result of the pressure created by these bubbles.

Figure 4:
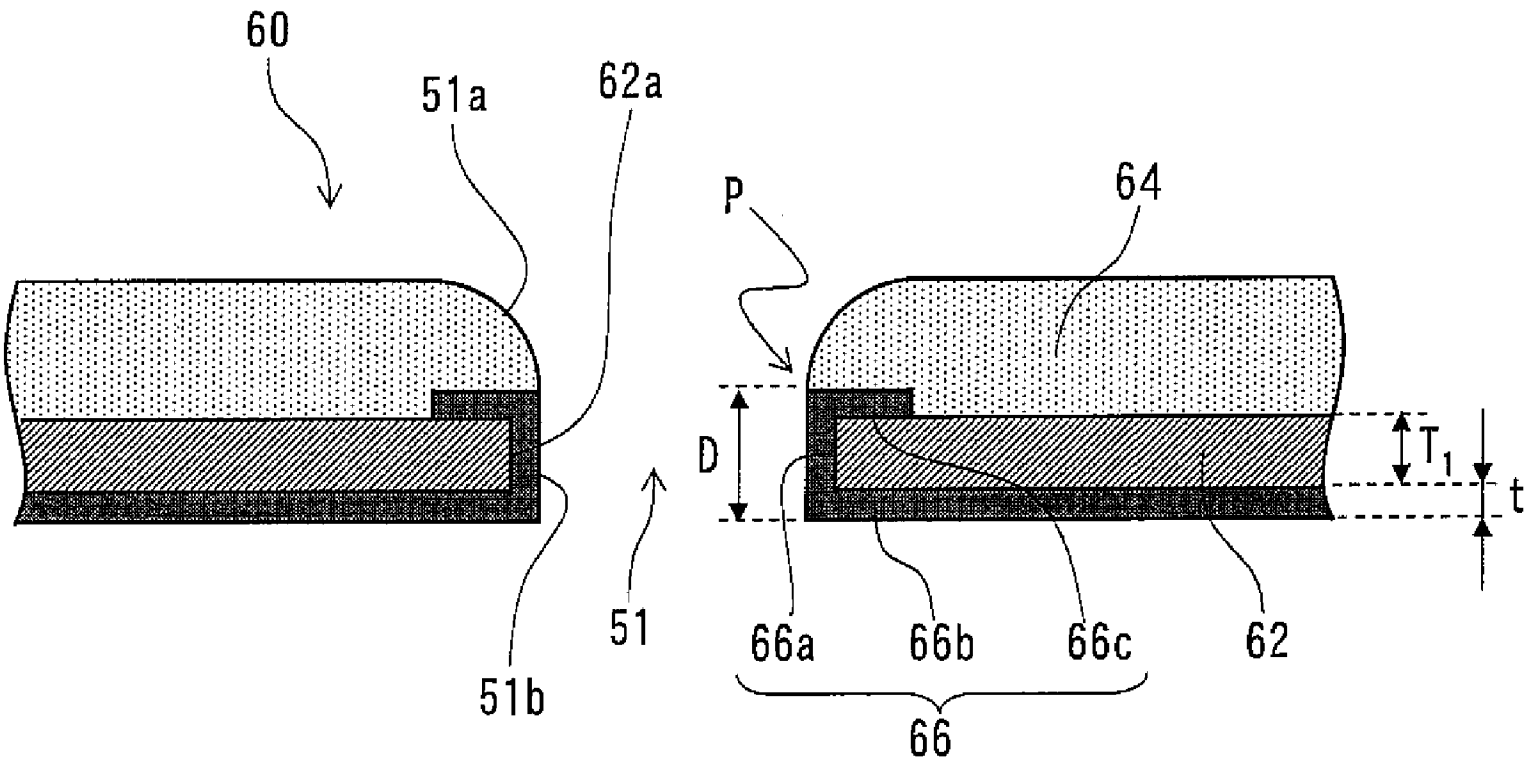
FIG. 4 is an enlarged cross-sectional diagram showing the perimeter section of a nozzle hole in a nozzle plate.

Next, the detailed structure of the nozzle plate 60 will be described. FIG. 4 is an enlarged cross-sectional diagram of the perimeter region of a nozzle hole 51, showing the detailed structure of the nozzle plate 60. As shown in FIG. 4, the nozzle plate 60 comprises three layers: a first metal layer 62, a second metal layer 64 and a lyophobic layer (liquid-repellent layer) 66.

Nozzles 51 are formed in the nozzle plate 60, each nozzle 51 comprising: a radius section 51*a* formed in a trumpet shape (circular arc shape) which converges in diameter toward the ink ejection side (the lower side in FIG. 4); and a straight section 51*b* which is formed in a circular cylindrical shape. The radius section 51*a* is disposed on the ink inflow side (the upper side in FIG. 4), and the straight section 51*b* is disposed on the ink ejection side. The smallest diameter portion of the radius section 51*a* (in other words, the portion on the ink ejection side) is formed to the same diameter as the inner diameter of the straight section 51*b*, and hence the structure is obtained in which there is no step difference from the radius section 51*a* to the straight section 51*b* on the inner surface (inner wall surface) of the nozzle hole 51. Accordingly, the flow of ink inside a nozzle hole 51 is smooth and the ejection stability of the ink droplets ejected from a nozzle hole 51 is improved. Furthermore, by disposing the radius section 51*a* on the ink inflow side of a nozzle hole 51, it is possible to keep the loss of the ejection energy applied by a piezoelectric element 58 small.

A hole section 62*a* is provided at a nozzle hole forming position in the first metal layer 62, and the lyophobic layer 66 is formed on the inner surface (inner wall) of the hole section 62*a* and the front and rear surfaces of the first metal layer 62. More specifically, a lyophobic layer 66*a* is formed on the inner surface of the hole section 62*a* in the first metal layer 62, and furthermore, a lyophobic layer 66*b* is formed on the whole of the front surface of the first metal layer 62 (namely, the surface on the ink ejection side, which is the lower surface in FIG. 4), and a lyophobic layer 66*c* is formed on the opening perimeter region of the hole section 62*a* on the rear surface of the first metal layer 62 (namely, the surface on the ink inflow side, which is the upper surface in FIG. 4). In other words, the lyophobic layer 66 is formed in a square U shape, from the front surface of the first metal layer 62, over the inner surface of the hole section 62*a*, and along the rear surface of the first metal layer 62.

In the present embodiment, as shown in FIG. 4, the lyophobic layer 66*b* is formed on the whole of the front surface of the first metal layer 62, but the lyophobic layer 66*b* may also be formed only on the opening perimeter region of the hole section 62*a* of the front surface of the first metal layer 62. However, from the viewpoint of improving the durability (wiping resistance) of the lyophobic layer 66*b* with respect to a wiping member, and the like, a desirable mode is one where the lyophobic layer 66*b* is formed over the whole of the front surface of the first metal layer 62. This is because, in a mode where the lyophobic layer 66*b* is formed only on the opening perimeter region of the hole section 62*a* on the front surface of the first metal layer 62, an interface with the lyophobic layer 66*b* is formed on the front surface of the first metal layer 62 and therefore the wiping resistance properties are inferior compared to a case where the lyophobic layer is formed over the whole of the front surface of the first metal layer 62.

Furthermore, as shown in FIG. 4, the lyophobic layer 66*c* on the rear surface of the first metal layer 62 is sandwiched between the first metal layer 62 and the second metal layer 64. A method of manufacturing a nozzle plate 60 according to the present embodiment will be described below, and the structure is formed in which the second metal layer 64 is formed on the first metal layer 62 by means of an overhang-type electroforming process, in such a manner that the second metal layer 64 covers the lyophobic layer 66*c*, and the end section of the lyophobic layer 66 (in other words, the lyophobic layer 66*c*) which is formed in a square U shape from the front surface of the first metal layer 62, over the inner surface of the hole section 51 and along the rear surface of the first metal layer 62, enters in between the first metal layer 62 and the second metal layer 64. By adopting a structure of this kind, the end sections of the lyophobic layer 66 are not exposed on the interior of the nozzle hole 51, and therefore detachment of the lyophobic layer 66 due to infiltration of ink into the interface between the lyophobic layer and the metal layer (the interface between the lyophobic layer 66 and the first metal layer 62) is prevented. At the interface between the lyophobic layer 66 and the second metal layer 64, the problem of detachment due to the inflow of ink is not liable to occur, because of the lyophobic action (liquid-repellent action) of the lyophobic agent molecules which are present in large numbers on the front surface side (second metal layer 64 side) of the lyophobic layer 66. Furthermore, since the end sections of the lyophobic layer 66 are not exposed on the front surface (the surface on the ink ejection side) of the nozzle plate 60, either, then the durability (wiping resistance) of the lyophobic layer 66 with respect to a wiping member, and the like, is also improved.

In the present embodiment, as described previously, the lyophobic layer 66 is formed in a square U shape from the front surface of the first metal layer 62, over the inner surface of a hole section 62*a* and along the rear surface of the first metal layer 62; therefore, taking the amount by which the lyophobic layer 66 enters in and extends over the inner surface of the nozzle hole 51 to be D, taking the thickness of the first metal layer 62 to be $T_1$, and taking the thickness of the lyophobic layer 66 to be t, the relationship, $D=T_1+2t$, is established. In other words, it is possible to control the amount of extension D of the lyophobic layer 66 over the inner surface of a nozzle hole 51, with good accuracy and without variation, in accordance with the thickness $T_1$ of the first metal layer 62. Consequently, it is possible to locate the meniscus accurately at a prescribed position inside a nozzle hole 51, and the ejection stability is improved since there is no wetting and spreading of the ink onto the opening perimeter section of a nozzle hole 51, on the ink ejection side.

In the present embodiment, since the first metal layer 62 and the second metal layer 64 do not make direct contact with each other inside the nozzle hole 51 (in other words, in the section which contacts the liquid), then it is possible to use metals of different types for the respective metal layers 62 and 64, and therefore the metal materials used can be optimized.

Next, a method of manufacturing a nozzle plate 60 according to an embodiment of the present invention will be described.

FIGS. 5A to 5H are illustrative diagrams showing one example of a method of manufacturing a nozzle plate 60 according to the present embodiment (a first method of manufacture).

Figure 5A:
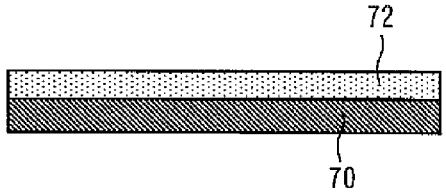
FIGS. 5A to 5H are illustrative diagrams showing one example of a method of manufacturing a nozzle plate.

Firstly, as shown in FIG. 5A, a photosensitive resin layer (resist layer) 72 is formed on a conductive substrate 70. More specifically, the photosensitive resin layer 72 is formed by applying a negative type photoresist to the whole of one surface of the conductive substrate 70, by means of a spin coater, or the like. In this case, the negative resist is applied in such a manner that the thickness of the photosensitive resin layer 72 is greater than the thickness of the first metal layer 62 which is formed in the subsequent electroforming step (see FIG. 5C). Although the description is omitted here, there is also a mode in which a positive type photoresist is applied.

Figure 5B:
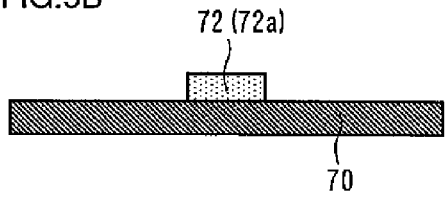

Subsequently, the photosensitive resin layer 72 is prebaked, according to requirements, and the exposure is carried out, using a mask (not illustrated) formed with an opening section corresponding to the nozzle hole 51 (the hole section 62*a* in the first metal layer 62) shown in FIG. 4. Thereupon, the exposed photosensitive resin layer 72 is developed, and then post-baked. In this way, as shown in FIG. 5B, the photosensitive resin layer 72 on the conductive substrate 70 is patterned into a round column shape which corresponds to the nozzle hole 51 (the hole section 62*a* of the first metal layer 62). The photosensitive resin layer after patterning is indicated by the reference numeral 72*a*.

Figure 5C:
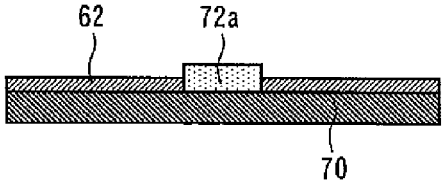

Thereupon, as shown in FIG. 5C, the first metal layer 62 is formed on the conductive substrate 70 by electroforming. More specifically, nickel electroforming is carried out, using the photosensitive resin layer 72*a* which has been patterned on the conductive substrate 70 as a mold for electroforming, whereby a first metal layer (Ni electroforming layer) 62 is deposited onto the surface of the conductive substrate 70 on the side of the photosensitive resin layer 72*a*. The thickness of the first metal layer 62 is less than the thickness of the photosensitive resin layer 72*a*, and is approximately 5 to 10 μm, for example.

Figure 5D:
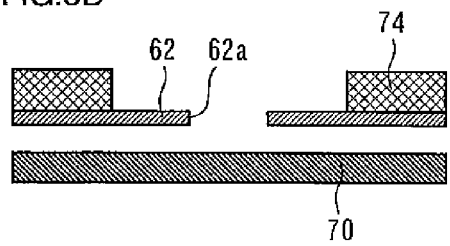

Thereupon, after removing the photosensitive resin layer 72*a* by means of an organic solvent, or the like, the rear surface side of the first metal layer 62 (the side opposite to the conductive substrate 70) is suctioned by means of a holding member 74 as shown in FIG. 5D, and the first metal layer 62 is detached from the conductive substrate 70. There are no particular restrictions on the mode of the holding member 74, provided that at least the opening perimeter region of the hole section 62*a* on the rear surface of the first metal layer 62 is exposed when in a state where the rear surface side of the first metal layer 62 is suctioned by means of the holding member 74. For example, the holding member 74 may be formed with openings corresponding to the respective hole sections 62*a* in the first metal layer 62, or it may be formed with one opening that corresponds to a plurality of hole sections 62*a*. Furthermore, it is also possible to form an opening over the whole of the region where all of the hole sections 62*a* are formed. Moreover, it is also possible to hold the first metal layer 62 by means of a plurality of holding members 74.

Figure 5E:
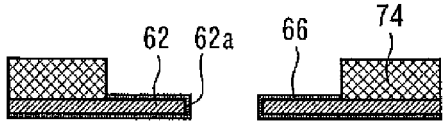

Thereupon, as shown in FIG. 5E, a lyophobic layer 66 is formed on the inner surface (inner wall) of each hole section 62*a* in the first metal layer 62 and the front and rear surfaces of the first metal layer 62, by vapor deposition, CVD, or the like, in a state where the rear surface side of the first metal layer 62 is suctioned to (or stuck to) the holding member 74. More specific examples are methods such as vacuum deposition of a fluorine resin, like PTFE, PVDF, PFA, and the like, and CVD of fluoroalkyl-silane; however, taking account of the level of adhesion with the substrate, the formation of a monomolecular film of fluoroalkyl-silane is desirable. Furthermore, in order to sufficiently reduce the surface tension after the formation of the lyophobic layer 66, it is desirable that the number of fluorine atoms in the fluoroalkyl-silane molecules should be 10 or more.

Moreover, the lyophobic layer 66*c* formed on the rear surface of the first metal layer 62 functions as a plating resist in the electroforming (overhang electroforming) step which is carried out subsequently, and therefore it is necessary for the lyophobic layer 66 formed in the present step to be constituted by a non-conductive material, at the least.

In this way, the lyophobic layer 66 is formed, not only on the front surface of the first metal layer 62 and the inner surface of each hole section 62*a*, but also over the rear surface of the first metal layer 62 in the region which is not suctioned to the holding member 74.

Figure 5F:
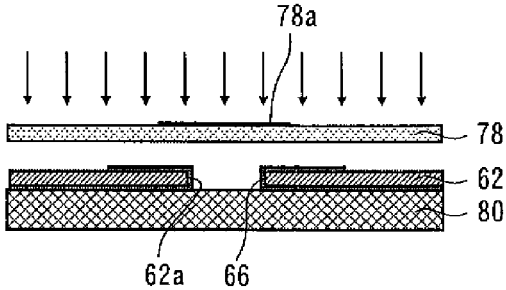
Figure 5G:
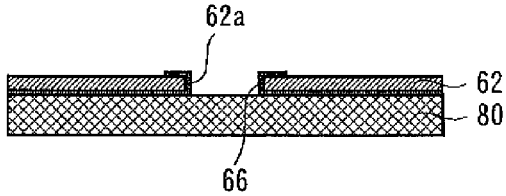

Next, after removing the holding member 74 from the first metal layer 62, as shown in FIG. 5F, the lyophobic layer 66 formed on the rear surface of the first metal layer 62 is patterned. More specifically, vacuum ultraviolet light is radiated onto the rear surface side of the first metal layer 62, via a mask 78 having a light shielding section 78*a* corresponding to the hole section 62*a* in the first metal layer 62 and the opening perimeter region of same. It is desirable that this process should be carried out in a state where the first metal layer 62 is mounted on a prescribed supporting member 80, in order to improve handling characteristics. As a result of this, as shown in FIG. 5G, unwanted portions of the lyophobic layer 66 on the rear surface of the first metal layer 62 are removed and the lyophobic layer 66 is thereby patterned to correspond to the region of the opening perimeter region of the hole section 62*a*, on the rear surface of the first metal layer 62.

In the lyophobic layer forming step shown in FIG. 5E, there is also a mode in which, when forming the lyophobic layer 66 on the rear surface of the first metal layer 62, the lyophobic layer 66 is formed from the start in a desired shape (see FIG. 5G) which is required in the subsequent overhang-type electroforming process. In this case, the lyophobic layer patterning step shown in FIG. 5F is not required.

Figure 5H:
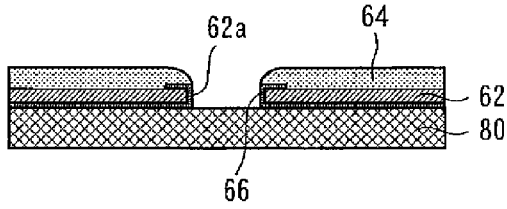

Thereupon, as shown in FIG. 5H, a second metal layer 64 is formed on the first metal layer 62 by electroforming, using the first metal layer 62 as a cathode. More specifically, a second metal layer 64 is deposited onto the rear surface side of the first metal layer 62, by nickel electroforming (overhang-type electroforming), using the lyophobic layer 66 on the rear surface of the first metal layer 62 (the lyophobic layer 66*c* in FIG. 4) as a plating resist. Consequently, the second metal layer 64 grows isotropically by riding over the lyophobic layer 66 on the rear surface of the first metal layer 62, and this second metal layer 64 is formed in a radius shape (circular are shape) as shown in FIG. 5H. When a prescribed time period has elapsed, the formation of the second metal layer 64 by the overhang-type electroforming process is halted, at the point where the front end section of the second metal layer 64 (on the side of the nozzle hole 51) coincides with the edge section P (see FIG. 4) where the lyophobic layer 66*a* on the inner surface of the hole section 62*a* in the first metal layer 62 intersects with the lyophobic layer 66*c* on the rear surface. In this way, the nozzle plate 60 comprising the first metal layer 62, the second metal layer 64 and the lyophobic layer 66, as shown in FIG. 4, is obtained.

Figure 6A:
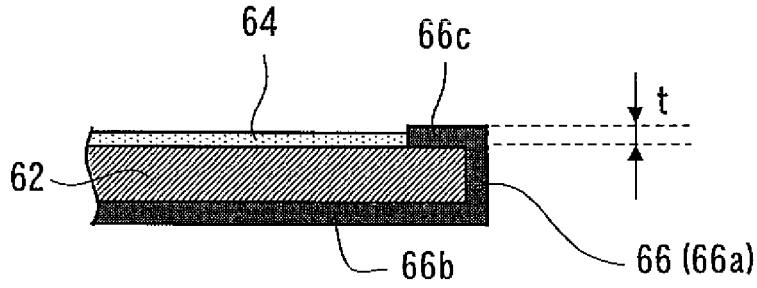
FIGS. 6A to 6C are illustrative diagrams showing an aspect where a second metal layer is formed on a first metal layer, by overhang electroforming.
Figure 6B:
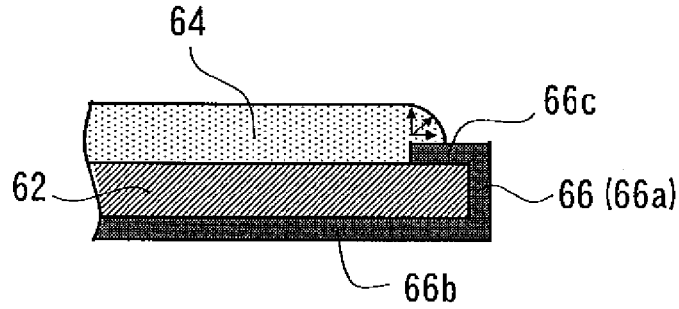
Figure 6C:
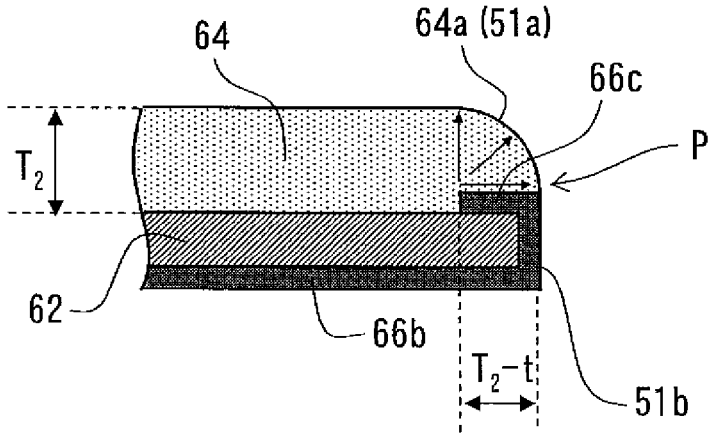

FIGS. 6A to 6C are illustrative diagrams showing an aspect where a second metal layer 64 is formed on the first metal layer 62 by the overhang-type electroforming. As shown in FIG. 6A, the second metal layer 64 which starts to grow from the rear surface of the first metal layer 62 grows only in the upward direction in FIG. 6A, until exceeding the lyophobic layer 66*c* of the thickness t on the rear surface of the first metal layer 62. Thereupon, when it has surpassed the lyophobic layer 66*c* of the thickness t, the second metal layer 64, which is no longer restricted by the lyophobic layer 66*c*, grows in an isotropic fashion (namely, in all directions), as shown in FIG. 6B. Therefore, if the ultimately required thickness of the second metal layer 64 is taken to be $T_2$, then it is possible to obtain a second metal layer 64 having a radius section 64*a* (which corresponds to the radius section 51*a* of the nozzle hole 51) of a circular arc shape having a radius of $T_2$−t, as shown in FIG. 6C.

In other words, the radius of the radius section 64*a* of the second metal layer 64 is equal to the difference between the ultimately required thickness $T_2$ of the second metal layer 64 and the thickness t of the lyophobic layer (in other words, $T_2$−t), and therefore the patterning should be carried out in such a manner that the width of the lyophobic layer 66*c* on the rear surface of the first metal layer 62 becomes $T_2$−t. By this means, simultaneously with obtaining the second metal layer 64 having a thickness of $T_2$, the front end section of the second metal layer 64 (on the side of the nozzle hole 51) is made to coincide with the edge section P of the lyophobic layer 66. As a result, since the inner surface of the nozzle hole 51 does not have ally step differences and is constituted by a continuous surface from the radius section 51*a* and along the straight section 51*b*, then the flow of ink inside a nozzle hole 51 is smooth and the ejection stability of an ink droplet ejected from a nozzle 51 is improved.

The first metal layer 62 and the second metal layer 64 may be made of the same metal or they may be made of different metals. For example, there is also a mode in which the first metal layer 62 is made of nickel (Ni), and the second metal layer 64 is made of NiFe alloy. Desirably, the first metal layer 62 is made of a hard and thin material, such as nickel cobalt (NiCo), whereby it is possible to improve the handling properties during manufacture of a nozzle plate.

Furthermore, by forming a lyophobic layer 66 in a square U shape from the front surface of the first metal layer 62, via the hole section 62*a* and along the rear surface, as well as forming a second metal layer 64 on the rear surface side of the first metal layer 62, by an overhang electroforming process, it is possible to accurately control the amount by which the lyophobic layer 66 extends over the inner surface of the nozzle hole 51, in accordance with the thickness of the first metal layer 62, and furthermore, since the end section of the lyophobic layer 66 (in other words, the lyophobic layer 66*c* on the rear surface of the first metal layer 62) is not exposed at the interior of the nozzle hole 51 or the front surface of the nozzle plate 60 (the surface on the ink ejection side), then the durability of the lyophobic layer 66 is improved.

Figure 7A:
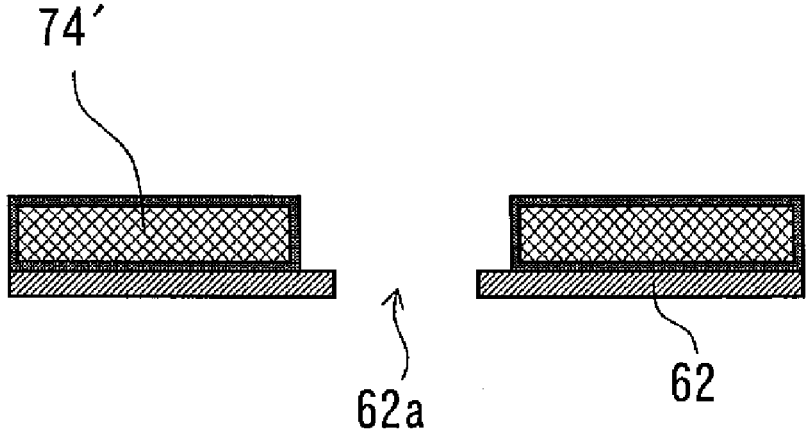
FIGS. 7A and 7B are illustrative diagrams showing a further example of a method of manufacturing a nozzle plate.
Figure 7B:
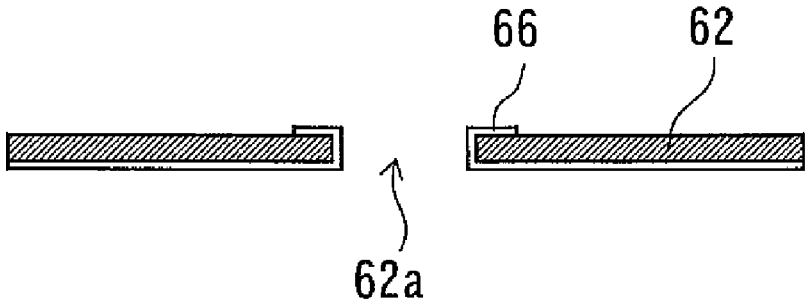

FIGS. 7A and 7B are illustrative diagrams showing a further example of the method of manufacturing a nozzle plate 60 according to the present embodiment (a second method of manufacture). In the present embodiment, as shown in FIG. 7A, the lyophobic layer 66 is formed by electrodeposition coating of a fluorine type resin, in a state where the holding member 74' is suctioned to the rear surface side of the first metal layer 62. In this case, the surface of the holding member 74' is previously treated to be non-conductive, and the holding member 74' used is one formed with an opening whereby the lyophobic layer 66 on the rear surface of the first metal layer 62 is patterned, from the start, to the desired shape (see FIG. 5G) which is required in the subsequent overhang electroforming process.

The electrodeposition coating may be anionic electrodeposition coating which uses the deposition receiving member (in the case of the present embodiment, the first metal layer 62) as an anode, or cationic electrodeposition coating which uses the deposition receiving member as a cathode. While either of these methods can be used, a cationic electrodeposition coating method is more desirable since there is no elution of the metal ions and therefore good accuracy can be maintained. Examples of an electrodeposition coating apparatus for fluorine resin include an apparatus made by Shimizu Co., Ltd. (Shimizu Elecoat Nicelon), for example. The film thickness can be set to approximately 5 to 20 μm.

When the holding member 74' is detached from the first metal layer 62 after carrying out the electrodeposition coating, then as shown in FIG. 7B, it is possible to obtain a lyophobic layer 66 patterned to a desired shape on the front surface of the first metal layer 62, the inner surface of the hole section 62*a* and the rear surface of the first metal layer 62. The other processing steps are similar to those of the first method of manufacture described above (see FIGS. 5A to 5H), and therefore description thereof is omitted here.

According to the present method of manufacture, it is possible to omit the step of patterning the lyophobic layer 66 (FIG. 5F) which is included in the first method of manufacture, and therefore productivity is improved.

Next, a second embodiment of the present invention will be described. Below, the parts of the second embodiment which are common to the first embodiment are not described, and the explanation focuses on the characteristic features of the present embodiment.

Figure 8:
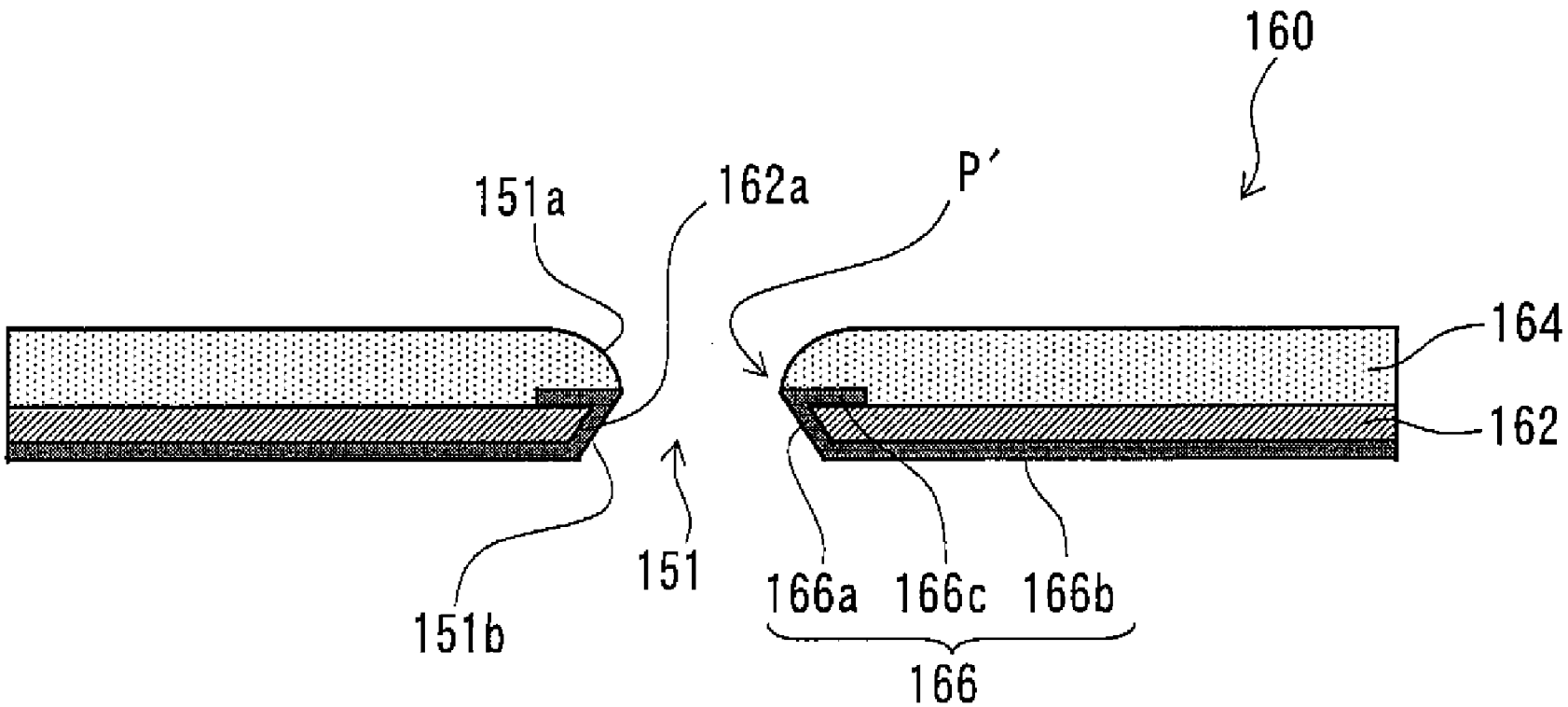
FIG. 8 is a cross-sectional diagram showing one portion of a nozzle plate according to a second embodiment.

FIG. 8 is a cross-sectional diagram showing a portion of a nozzle plate 160 according to the second embodiment. As shown in FIG. 8, the nozzle plate 160 according to the present embodiment is similar to the nozzle plate 60 of the first embodiment in that it is constituted by three layers, namely, a first metal layer 162, a second metal layer 164, and a lyophobic layer 166, but the shape of the nozzle hole 151 is different from that of the first embodiment.

The hole section 162*a* formed in the first metal layer 162 differs from the hole section 62 of the first embodiment in that, rather than being formed in a straight shape (round cylindrical shape), it is formed in an inverted taper shape (truncated circular cone shape) which broadens in diameter toward the ink ejection side (the lower side in FIG. 8).

A nozzle hole 151 formed in the nozzle plate 160 according to the present embodiment comprises a radius section 151*a* which is formed in a trumpet shape (circular arc shape) that narrows in diameter toward the ink ejection side, and an inverted taper section 151*b* which is formed in an inverted taper shape (inverted circular truncated cone shape) that broadens in diameter toward the ink ejection side. The radius section 151*a* is disposed on the ink inflow side (the upper side in FIG. 8) and the inverted taper section 151*b* is disposed on the ink ejection side. The interior of the nozzle hole 151 has a shape which bends at the position of the boundary between the second metal layer 164 and the lyophobic layer 166.

In the present embodiment, similarly to the first embodiment, the lyophobic layer 166 is formed in a square U shape from the front surface of the first metal layer 162, over the inner surface of the hole section 162*a* and along the rear surface of the first metal layer 162, and therefore it is possible accurately to control the amount by which the lyophobic layer 166 enters into and extends over the inner surface of the nozzle hole 151, in accordance with the thickness of the first metal layer 162, and furthermore, since the nozzle hole 151 has a shape which bends at the position of the boundary between the second metal layer 164 and the lyophobic layer 166, then the clip point for the meniscus is more clearly defined, and the flow channel resistance is also reduced. Consequently, the ejection characteristics for an ink droplets ejected from the nozzle 151 are stabilized and the ejection efficiency is also improved.

Figure 9A:
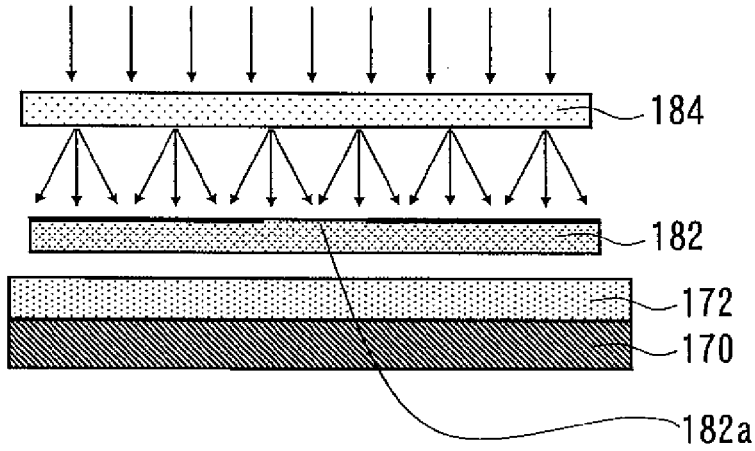
FIGS. 9A to 9E are illustrative diagrams showing one example of a method of manufacturing a nozzle plate according to the second embodiment.
Figure 9B:
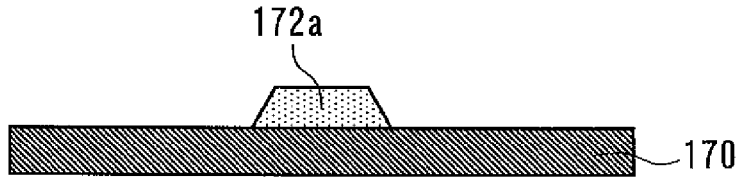
Figure 9C:
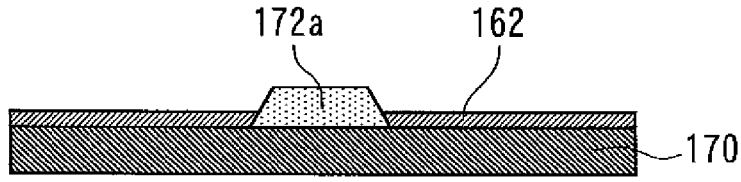
Figure 9D:
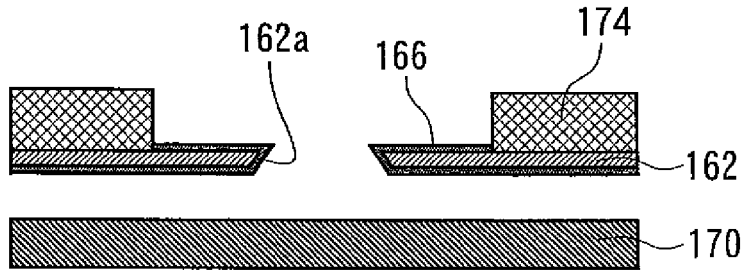
Figure 9E:
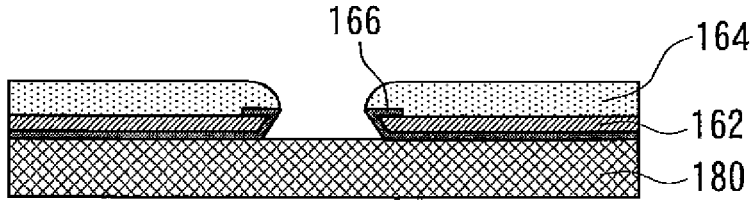

FIGS. 9A to 9E are illustrative diagrams showing one example of a method of manufacturing a nozzle plate 160 according to the second embodiment (a third method of manufacture). Firstly, as shown in FIG. 9A, similarly to the first embodiment, a photosensitive resin (resist layer) 172 is formed on a conductive substrate 170, whereupon diffused light is radiated onto the photosensitive resin layer 172 via a mask 182 having an opening section 182*a* which corresponds to the nozzle hole 161. For example, parallel light may be radiated onto the photosensitive resin layer 172 via a diffusion plate 184 and the mask 182, as shown in FIG. 9A. Thereupon, development is carried out, whereby a photosensitive resin layer 172 (172*a*) having a tapered shape (truncated circular cone shape) can be obtained on the conductive substrate 170, as shown in FIG. 9B. The subsequent steps are similar to those of the first embodiment, and therefore detailed description thereof is omitted here, but a first metal layer (nickel electroforming layer) 162 is formed on the conductive substrate 170 by electroforming (FIG. 9C), the first metal layer 162 is detached from the conductive substrate 170 by causing a holding member 174 to suction to the rear surface side of the first metal layer 162, and in this state, a lyophobic layer 166 is formed on the inner surface of the hole section 162*a* in the first metal layer 162 and the front and rear surfaces of the first metal layer 162 (FIG. 9D), the lyophobic layer 166 on the rear surface of the first metal layer 162 is patterned according to requirements, and a second metal layer (nickel electroforming layer) 164 is then formed on the rear surface side of the first metal layer 162 by means of an overhang-type electroforming process (FIG. 9E).

In this way, as shown in FIG. 8, it is possible to obtain a nozzle plate 160 according to the present embodiment. In the case of this method of manufacture also, as shown in FIG. 8, the front end (on the nozzle hole 151 side) of the second metal layer 164 can be formed by the overhang electroforming so as to coincide accurately with the edge section P' where the lyophobic layer 166*a* on the inner surface of the hole section 162*a* of the first metal layer 162 intersects with the lyophobic layer 166*c* on the rear surface of the first metal layer 162. Consequently, similarly to the first and second methods of manufacture described above, no step difference occurs inside a nozzle hole 151 (and in particular, at the position of the boundary between the second metal layer 164 and the lyophobic layer 166) and the amount by which the lyophobic layer 166 extends inside the nozzle hole 151 can be controlled with good accuracy, in accordance with the thickness of the first metal layer 162. Therefore, it is possible accurately to specify the position of the meniscus inside a nozzle hole 151, and the ejection stability can be improved.

Figure 10:
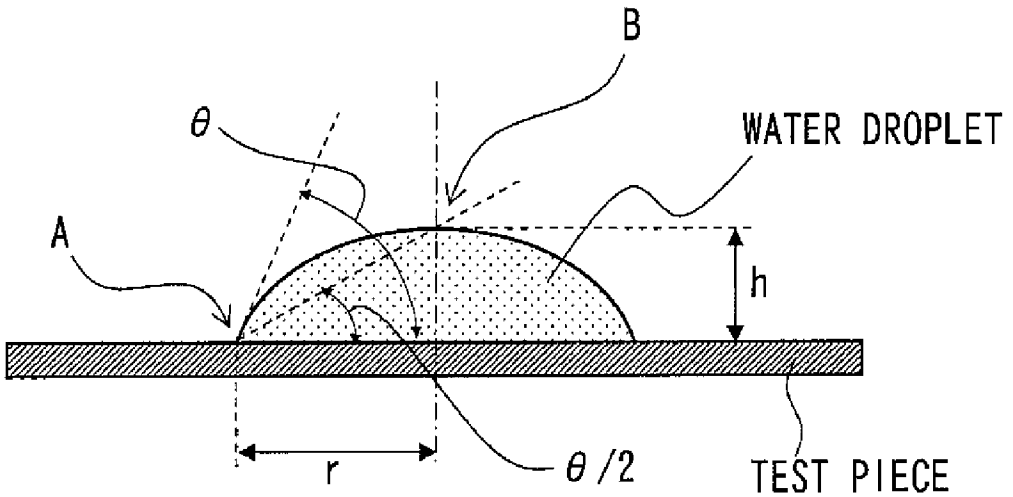
FIG. 10 is an illustrative diagram of a wetting test method.

The definitions of "lyophobic (liquid-repellent)" and "lyophilic" in the present application are based on the angle of contact as measured by the wetting test method (JIS R3257) on the surface of a glass substrate as described below. More specifically, as shown in FIG. 10, when a droplet of water is stationary on a horizontally arranged test piece, then if the volume of the droplet is 4 (μl) or less, the shape of the droplet can be regarded as a portion of a sphere, and therefore the following relationship is established between the angle of contact, θ, and the droplet.

$$\theta = 2\tan^{-1}\frac{h}{r} \qquad \text{Formula 1}$$

Here, the radius of the surface of the droplet which makes contact with the test piece is r (mm), and the height from the surface of the test piece until the topmost point of the droplet is h (mm).

The angle of contact, θ, is determined according to Formula (1) on the basis of the measured values of "r" and "h".

Apart from a method which involves determining the values of r and h, it is also possible to determine the angle of contact, θ, by drawing the line "A-B" in FIG. 10 (where B is the topmost point of the droplet) by means of an optical reading apparatus, reading out the angle θ/2 between the line A-B and the surface of the test piece directly, and then multiplying it by two.

In general, a material having an angle of contact θ, as measured in this way, of 90 degrees or lower is regarded as lyophilic, a material having an angle of contact θ of 90 degrees or above is regarded as lyophobic, and a material having an angle of contact θ of 150 degrees or above is regarded as ultra-lyophobic; however, since ink generally has a low surface tension, then in relation to an inkjet head, it is not possible to use a general angle of contact value of 90 degrees or above as a standard value for lyophobic properties (even if a surface is coated with a lyophobic agent, the angle of contact measured using ink does not become 90 degrees or above). Therefore, as a provisional standard value, an angle of contact greater than 100 degrees is set for pure water, and an angle of contact greater than 60 degrees is set for ink.

In the present specification, "lyophobic" means that the angle of contact θ measured by the method described above is greater than 100 degrees in the case of water and greater than 60 degrees in the case of ink, and all other cases are regarded as "lyophilic".

Nozzle plates, methods of manufacturing a nozzle plate, liquid droplet ejection heads and image forming apparatuses according to the present invention have been described in detail above, but the present invention is not limited to the aforementioned examples, and it is of course possible for improvements or modifications of various kinds to be implemented, within a range which does not deviate from the essence of the present invention. For example, it can also be applied widely to a liquid ejection apparatus (a dispenser, or the like) which ejects a liquid (water, treatment liquid, resist, or the like) onto an ejection receiving medium (a wafer, printed substrate, or the like).

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle plate comprising:

a first metal layer in which a hole section corresponding to a nozzle hole is formed;

a liquid-repellent layer formed on a front surface of the first metal layer, an inner surface of the hole section in the first metal layer, and an opening perimeter region of the hole section on a rear surface of the first metal layer; and a second metal layer formed on a rear surface side of the first metal layer, wherein the liquid-repellent layer on the rear surface of the first metal layer is sandwiched between the first metal layer and the second metal layer.

2. A liquid ejection head comprising the nozzle plate as defined in claim 1.

3. An image forming apparatus comprising the liquid ejection head as defined in claim 2.

* * * * *